US005931769A

United States Patent [19]

Nunez

[11] Patent Number: 5,931,769

[45] Date of Patent: Aug. 3, 1999

[54] EXERCISE DEVICE

[76] Inventor: Luis Alberto Nunez, Gecko Farms P.O. Box 89 3 KM North of Iglesia de Birri Barva, Heredia, 3011, Costa Rica

[21] Appl. No.: 09/121,323

[22] Filed: Jul. 23, 1998

[51] Int. Cl.[6] ..... A63B 21/00

[52] U.S. Cl. ..... 482/142; 482/140; 482/121

[58] Field of Search ..... 482/140, 142, 482/30, 31, 32, 130, 112, 111, 113, 121, 94, 95, 96, 123

[56] References Cited

U.S. PATENT DOCUMENTS

| | | | |
|---|---|---|---|
| 1,973,945 | 9/1934 | Chavin | 482/130 |
| 3,767,190 | 10/1973 | Biggerstaff | 482/142 |
| 3,787,049 | 1/1974 | Rellinger | 482/142 |
| 4,583,731 | 4/1986 | Crivello | 482/138 |
| 4,927,139 | 5/1990 | Taltre | 482/142 |
| 5,100,131 | 3/1992 | Fong | 482/112 |
| 5,215,511 | 6/1993 | Cheng | 482/121 |
| 5,217,487 | 6/1993 | Engle | 606/240 |
| 5,308,306 | 5/1994 | Wang | 482/142 |
| 5,573,485 | 11/1996 | Geschwender | 482/112 |
| 5,580,340 | 12/1996 | Yu | 482/96 |
| 5,584,786 | 12/1996 | Almeda | 482/140 |
| 5,599,261 | 2/1997 | Easley | 482/130 |
| 5,624,361 | 4/1997 | Lai | 482/130 |
| 5,795,276 | 8/1998 | Almeda | 482/140 |
| 5,833,590 | 11/1998 | Chiu | 482/142 |

*Primary Examiner*—Jerome Donnelly
*Assistant Examiner*—William LaMarca

[57] ABSTRACT

An exercise device for exercising and massaging the back of a user. The exercise device includes a base frame and a back rest pivotally coupled to the top of the base frame. The spring is provided for biasing the pivoting of the back rest in a direction away from the back of the base frame and towards the front of the base frame.

5 Claims, 2 Drawing Sheets

EXERCISE DEVICE

BACKGROUND OF THE INVENTION

1. Field of the Invention

The present invention relates to exercise devices and more particularly pertains to a new exercise device for exercising and massaging the back of a user.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U. S. Pat. No. 5,100,131; U.S. Pat. No. 5,545,114; U.S. Pat. No. 4,739,749; U.S. Pat. No. 3,081085; U.S. Pat. No. Des. 269,543; and U.S. Pat. No. 1,693,810.

While these devices fulfill their respective, particular objectives and requirements, the aforementioned patents do not disclose a new exercise device. The inventive device includes a base frame and a back rest pivotally coupled to the top of the base frame. The spring is provided for biasing the pivoting of the back rest in a direction away from the back of the base frame and towards the front of the base frame.

In these respects, the exercise device according to the present invention substantially departs from the conventional concepts and designs of the prior art, and in so doing provides an apparatus primarily developed for the purpose of exercising and massaging the back of a user.

SUMMARY OF THE INVENTION

In view of the foregoing disadvantages inherent in the known types of exercise devices now present in the prior art, the present invention provides a new exercise device construction wherein the same can be utilized for exercising and massaging the back of a user.

The general purpose of the present invention, which will be described subsequently in greater detail, is to provide a new exercise device apparatus and method which has many of the advantages of the exercise devices mentioned heretofore and many novel features that result in a new exercise device which is not anticipated, rendered obvious, suggested, or even implied by any of the prior art exercise devices, either alone or in any combination thereof.

To attain this, the present invention generally comprises a base frame and a back rest pivotally coupled to the top of the base frame. The spring is provided for biasing the pivoting of the back rest in a direction away from the back of the base frame and towards the front of the base frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise device apparatus and method which has many of the advantages of the exercise devices mentioned heretofore and many novel features that result in a new exercise device which is not anticipated, rendered obvious, suggested, or even implied by any of the prior art exercise devices, either alone or in any combination thereof.

It is another object of the present invention to provide a new exercise device which may be easily and efficiently manufactured and marketed.

It is a further object of the present invention to provide a new exercise device which is of a durable and reliable construction.

An even further object of the present invention is to provide a new exercise device which is susceptible of a low cost of manufacture with regard to both materials and labor, and which accordingly is then susceptible of low prices of sale to the consuming public, thereby making such exercise device economically available to the buying public.

Still yet another object of the present invention is to provide a new exercise device which provides in the apparatuses and methods of the prior art some of the advantages thereof, while simultaneously overcoming some of the disadvantages normally associated therewith.

Still another object of the present invention is to provide a new exercise device for exercising and massaging the back of a user.

Yet another object of the present invention is to provide a new exercise device which includes a base frame and a back rest pivotally coupled to the top of the base frame. The spring is provided for biasing the pivoting of the back rest in a direction away from the back of the base frame and towards the front of the base frame.

Many people experience pain and discomfort when their back gets out of alignment or their internal organs shift under the pressure of sitting or standing for a prolonged period of time. In many cases, a trip to the chiropractor may be required to relieve the pain. Still yet another object of the present invention is to provide a new exercise device that helps properly align the vertebrae in the user's back and help return the user's muscles and internal organs to their original position and thereby alleviate any back pain the user may have.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
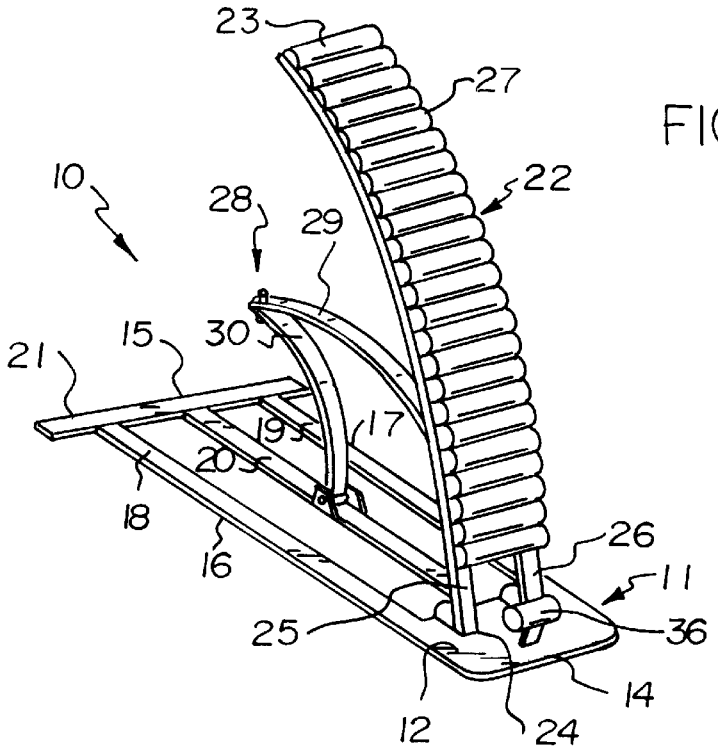
FIG. 1 is a schematic front perspective view of a new exercise device according to the present invention.
Figure 2:
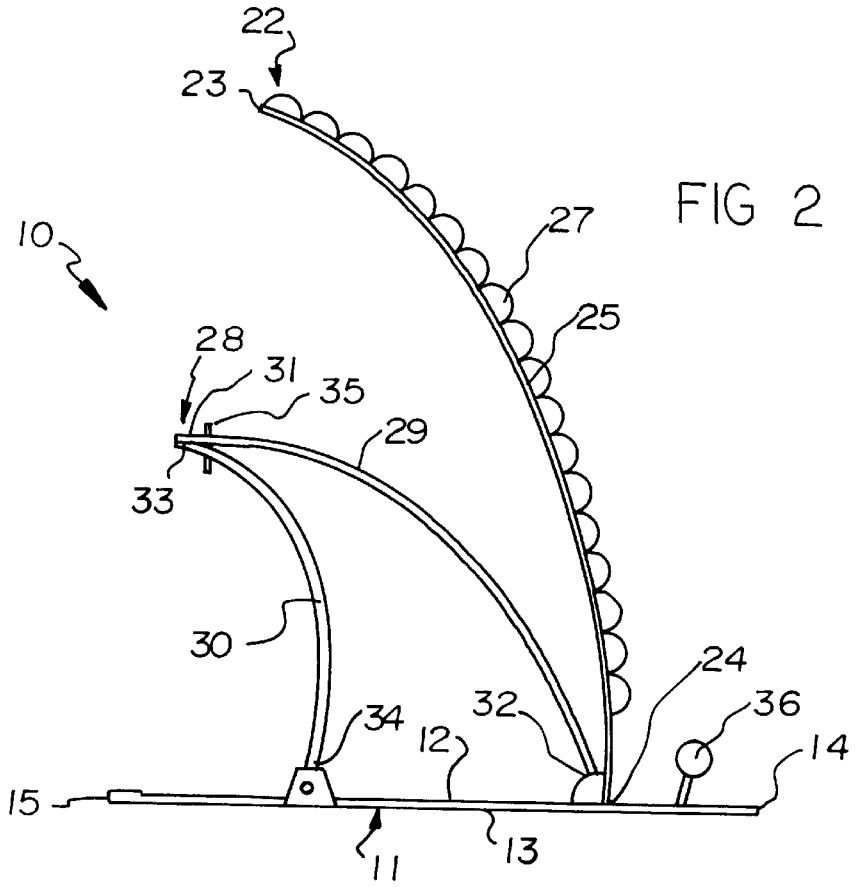
FIG. 2 is a schematic side view of the present invention.
Figure 3:
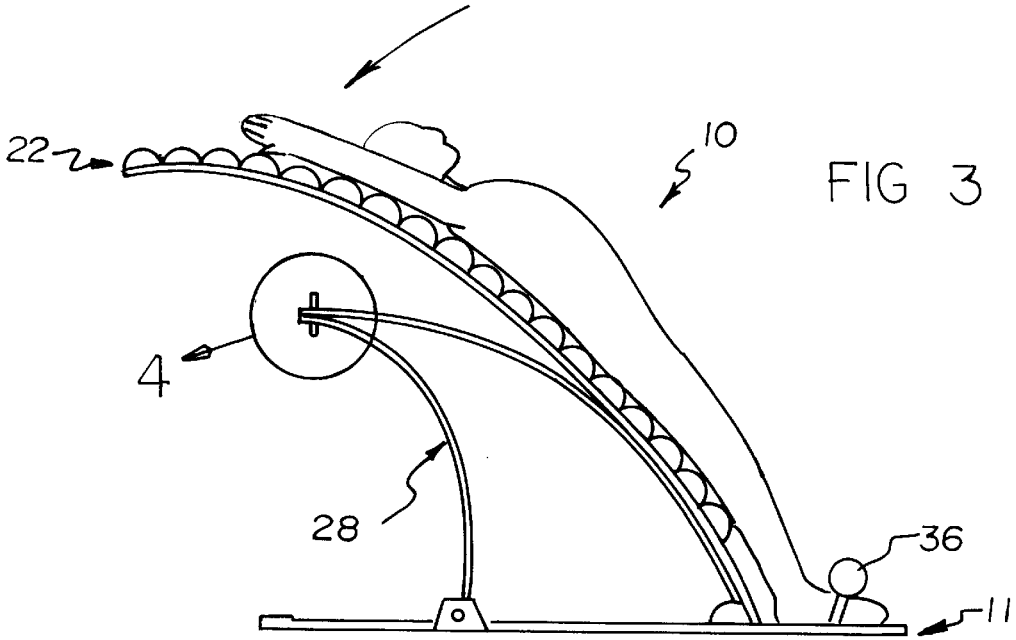
FIG. 3 is a schematic side view of the present invention in use with the back rest being pivoted towards the back of the base frame to a reclined position.
Figure 4:
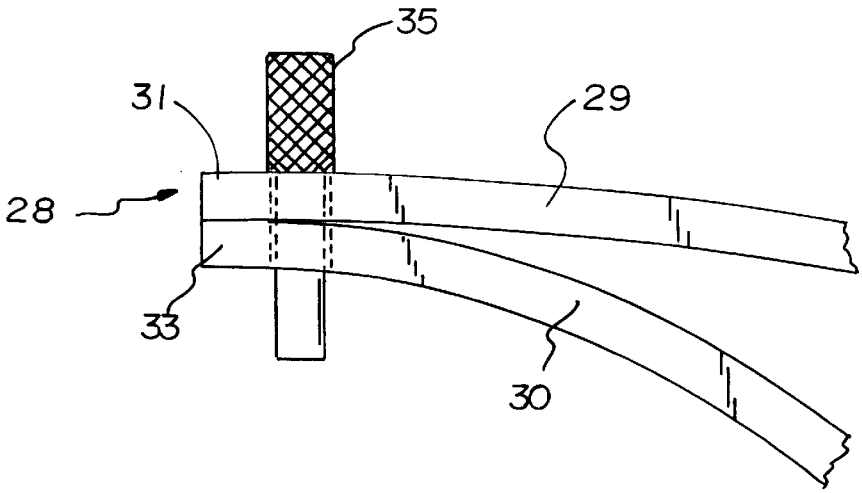
FIG. 4 is a schematic partial side view of the present invention taken from the circle 4 on FIG. 3.

With reference now to the drawings, and in particular to FIGS. 1 through 4 thereof, a new exercise device embodying the principles and concepts of the present invention and generally designated by the reference numeral 10 will be described.

The exercise device 10 is designed for exercising and massaging the back of a user to help properly align the vertebrae of the back of the user and help proper align the internal organs in the torso of the user. As best illustrated in FIGS. 1 through 4, the exercise device 10 generally comprises a base frame 11 and a back rest 22 pivotally coupled to the top 12 of the base frame 11. The spring 28 is provided for biasing the pivoting of the back rest 22 in a direction away from the back 15 of the base frame 11 and towards the front 14 of the base frame 11.

Specifically, the base frame 11 has a top 12, a bottom 13, a front 14, a back 15, and a pair of sides 16,17 extending between the front and back 14,15 of the base frame 11. Preferably, the base frame 11 has three spaced apart base rails 18,19,20 extending between the front and back 14,15 of the base frame 11. One of the base rails 18 is positioned adjacent one of the sides 16 of the base frame 11, another of the base rails 19 is positioned adjacent another of the sides 17 of the base frame 11, and a third of the base rails 20 is positioned at a midpoint between the sides 16,17 of the base frame 11. The base frame 11 also preferably has an elongate back rail 21 positioned adjacent the back 15 of the base frame 11. The back rail 21 has a longitudinal axis extending generally perpendicular to the lengths of the base rails 18,19,20 such that the ends of the back rail 21 extend from either side of the base frame 11. The back rail 21 is designed for providing additional stability to the exercise device during use.

The back rest 22 is generally arcuate and has opposite top and bottom ends 23,24, and front and back faces. The bottom end 24 of the back rest 22 is pivotally coupled to the top 12 of the base frame 11 and is positioned towards the front 14 of the base frame 11. The front face of the back rest 22 faces in a direction towards the front 14 of the base frame 11 while the back face of the back rest 22 faces in a direction towards the back 15 of the base frame 11. In use, the front face of the back rest 22 is designed for positioning the back of a user against it. The back rest 22 has a pair of spaced apart elongate support rails 25,26 located adjacent the back face of the back rest 22. Each of the support rails 25,26 has a length defined between the top and bottom ends 23,24 of the back rest 22 which extend generally parallel to one another. The back rest 22 has a row of cushion ribs 27 forwardly extending from the front face of the back rest 22 with each cushion rib coupled to each of the support rails 25,26. The row of cushion ribs 27 has a length extending between the top and bottom ends 23,24 of the back rest 22. Ideally, each of the cushion ribs 27 has a generally semi-circular cross section taken along a line extending along the length of the back rest 22.

The spring 28 is provided for biasing the pivoting of the back rest 22 in a direction away from the back 15 of the base frame 11 and towards the front 14 of the base frame 11. The spring 28 preferably has resiliently deflectable elongate and arcuate front and back leafs 29,30. The front and back leafs 29,30 each have upper and lower ends 31,33,32,34. The lower end 34 of the back leaf 30 is pivotally coupled to the third base rail 20 of the base frame 11 at a point between the back 15 of the base frame 11 and the bottom end 24 of the back rest 22. Preferably, the lower end 34 of the back leaf 30 is detachably attached to the third base rail of the base frame 11 for permitting easy collapsing of the spring 28 for convenient storage. The lower end 32 of the front leaf 29 is coupled to the base frame 11 at a point adjacent the back face of the bottom end 24 of the back rest 22. The upper ends 31,33 of the front and back leafs 29,30 are coupled together preferably by a fastener 35 such as a pull pin for permitting easy collapsing of the spring 28 for convenient storage.

In use, the spring 28 biases the pivoting of the back rest 22 in a direction away from the back 15 of the base frame 11 and towards the front 14 of the base frame 11. When the back rest 22 is first pivoted in a direction towards the back 15 of the base frame 11 such that the back face of the back rest 22 abuts the front leaf 29 to deflect the front and back leafs 29,30, the return of the leaves 29,30 to their original positions forces the back rest 22 to pivot in a direction towards the front 14 of the base frame 11.

Preferably, a T-shaped foot restraint 36 is coupled to the top 12 of the base frame 11 between the front face of the back rest 22 and the front 14 of the base frame 11. The foot restraint 36 is adapted for holding in place the feet of a user standing on the top 12 of the base frame 11 adjacent the front face of the back rest 22. The foot restraint 36 preferably comprises a pair of cylindrical pads mounted on a T-shaped cross bar. Optionally, the foot restraint 36 may be foot strap.

In an ideal illustrative embodiment, the base frame 11 has a length defined between the front and back 14,15 of the base frame 11 of about 6 feet, a width defined between the sides 16,17 of the base frame 11 of about 2 feet. In this ideal illustrative embodiment, the back rail 21 of the base frame 11 preferably has a length between the ends of the back rail 21 of about 4 feet. The back rest 22 ideally has a length defined between the top and bottom ends 23,24 of the back rest 22 of about 7 feet and a width defined between the support rails 25,26 of the back rest 22 of about 1½ feet. In this ideal illustrative embodiment, each of the cushion ribs 27 preferably has a radius of about 2 inches.

In use, a user stands on the top 12 of the base frame 11 adjacent the front face of the back rest 22 with the back of the user positioned against the front face of the back rest 22. The user then secures their feet to the base frame 11 with the foot restraint 36 and raises their arms above their head. The user then leans back on the back rest 22 to recline the back rest 22 and then slowly returns to the standing upright position before repeating the movement. After several repetitions the user should feel more relaxed and any back pain should be reduced.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device, comprising:

a base frame having a top, a front, and a back;

a back rest having opposite top and bottom ends and a front and a back face;

said bottom end of said back rest being pivotally coupled to said top of said base frame; and a spring for biasing said back rest in a direction away from said back of said base frame and towards said front of said base frame;

wherein said spring has resiliently deflectable elongate front and back leafs, said front and back leafs each having upper and lower ends, said lower end of said back leaf being pivotally coupled to said base frame at a point between said back of said base frame and said bottom end of said back rest, said lower end of said front leaf being coupled to said base frame at a point adjacent said bottom end of said back rest, and said upper ends of said front and back leafs being coupled together.

2. The exercise device of claim 1, wherein said base frame has a pair of sides extending between said front and back of said base frame, wherein said base frame has three spaced apart base rails extending between said front and back of said base frame, one of said base rails being positioned adjacent one of said sides of said base frame, another of said base rails being positioned adjacent another of said sides of said base frame, a third of said base rails being positioned at a midpoint between said sides of said base frame, and wherein said base frame has an elongate back rail positioned adjacent said back of said base frame, said back rail having a pair of opposite ends, said back rail having a longitudinal axis extending generally perpendicular to said sides of said base rail such that said ends of said back rail extend from either side of said base frame.

3. The exercise device of claim 1, wherein said back rest having a pair of spaced apart elongate support rails, and a row of cushion ribs coupled to each of said support rails, said row of cushion ribs having a length extending between said top and bottom ends of said back rest.

4. The exercise device of claim 1, further comprising a foot restraint coupled to said top of said base frame between said back rest and said front of said base frame.

5. An exercise device, comprising:

a base frame having a top, a bottom, a front, a back, and a pair of sides extending between said front and back of said base frame;

said base frame having three spaced apart base rails extending between said front and back of said base frame, one of said base rails being positioned adjacent one of said sides of said base frame, another of said base rails being positioned adjacent another of said sides of said base frame, a third of said base rails being positioned at a midpoint between said sides of said base frame;

said base frame having an elongate back rail positioned adjacent said back of said base frame, said back rail having a pair of opposite ends, said back rail having a longitudinal axis extending generally perpendicular to said sides of said base rail such that said ends of said back rail extend from either side of said base frame;

an back rest being generally arcuate and having opposite top and bottom ends, and front and back faces;

said bottom end of said back rest being pivotally coupled to said top of said base frame, said bottom end of said back rest being positioned towards said front of said base frame, said front face of said back rest facing in a direction towards said front of said base frame, said back face of said back rest facing in a direction towards said back of said base frame;

said back rest having a pair of spaced apart elongate support rails located adjacent said back face of said back rest, each of said support rails having a length defined between said top and bottom ends of said back rest, said lengths of said support rails being extended generally parallel to one another;

said back rest having a row of cushion ribs extending from said front face of said back rest, each of said cushion ribs being coupled to each of said support rails, said row of cushion ribs having a length extending between said top and bottom ends of said back rest, each of said cushion ribs having a generally semi-circular cross section taken along a line extending along said length of said back rest;

a spring for biasing pivoting of said back rest in a direction away from said back of said base frame and towards said front of said base frame, said spring having resiliently deflectable elongate front and back leafs;

said front and back leafs each having upper and lower ends and a length defined between said upper end lower ends of the leaf;

said lower end of said back leaf being pivotally coupled to said third base rail of said base frame at a point between said back of said base frame and said back end of said back rest, wherein said lower end of said back leaf is detachably attached to said third base rail of said base frame;

said lower end of said front leaf being coupled to said base frame at a point adjacent said bottom end of said back rest;

said upper ends of said front and back leafs being coupled together, wherein a fastener detachably couples said upper ends of said front and back leafs; and a foot restraint being coupled to said top of said base frame between said front face of said back rest and said front of said base frame, said foot restraint being adapted for holding in place the feet of a user standing on said top of said base frame adjacent said front face of said back rest.

* * * * *